US009704351B2

(12) United States Patent
Tidke

(10) Patent No.: US 9,704,351 B2
(45) Date of Patent: Jul. 11, 2017

(54) METHOD OF GAMING, A GAME CONTROLLER AND A GAMING SYSTEM

(71) Applicant: Aristocrat Technologies Australia Pty Limited, North Ryde (AU)

(72) Inventor: Hemant Tidke, Ryde (AU)

(73) Assignee: Aristocrat Technologies Australia Pty Limited (AU)

( * ) Notice: Subject to any disclaimer, the term of this patent is extended or adjusted under 35 U.S.C. 154(b) by 644 days.

(21) Appl. No.: 14/196,111

(22) Filed: Mar. 4, 2014

(65) Prior Publication Data

US 2014/0248938 A1 Sep. 4, 2014

(30) Foreign Application Priority Data

Mar. 4, 2013 (AU) ..... 2013900729

(51) Int. Cl.

| | |
|---|---|
| ***A63F 9/24*** | (2006.01) |
| ***G07F 17/34*** | (2006.01) |
| ***G07F 17/32*** | (2006.01) |

(52) U.S. Cl.

CPC ..... *G07F 17/34* (2013.01); *G07F 17/32* (2013.01); *G07F 17/326* (2013.01); *G07F 17/3262* (2013.01); *G07F 17/3265* (2013.01)

(58) Field of Classification Search

CPC .. G07F 17/34; G07F 17/3262; G07F 17/3265; G07F 17/32; G07F 17/326

USPC ..... 463/16, 20, 42

See application file for complete search history.

(56) References Cited

U.S. PATENT DOCUMENTS

| | | | | |
|---|---|---|---|---|
| 5,536,911 | A | 7/1996 | Madill | |
| 6,270,412 | B1 | 8/2001 | Crawford et al. | |
| 8,641,510 | B2 * | 2/2014 | Singer | G07F 17/32 463/20 |
| 2006/0030387 | A1 | 2/2006 | Jackson | |

(Continued)

FOREIGN PATENT DOCUMENTS

| | | | |
|---|---|---|---|
| AU | 2006200954 | A1 | 3/2007 |
| AU | 2006200954 | B2 | 1/2012 |

(Continued)

*Primary Examiner* — Jay Liddle
*Assistant Examiner* — Ryan Hsu
(74) *Attorney, Agent, or Firm* — McAndrews, Held & Malloy, Ltd.

(57) ABSTRACT

A gaming system comprises a display, a symbol determiner for determining, for each of a plurality of game instances corresponding to respective ones of a plurality of display areas on a display, a set of symbols for display at a plurality of display positions arranged in an array in the respective display area, wherein determining the set of symbols comprises a symbol selector selecting one or more of the symbols and wherein selecting one or more of the symbols by the symbol selector can result in the selection of a replicating symbol, a symbol replicator for, upon a replicating symbol being selected at a display position of at least one game instance that satisfies one or more adjacency criteria with respect to a corresponding display position of another game instance, replicating the replicating symbol at the corresponding display position of the other game instance, and a symbol evaluator for evaluating symbols, including the replicated replicating symbol, displayed at the display positions of the other game instance to determine whether to make an award.

26 Claims, 11 Drawing Sheets

(56) References Cited

U.S. PATENT DOCUMENTS

| | | | | |
|---|---|---|---|---|
| 2007/0219026 | A1 | 9/2007 | Lo | |
| 2008/0102916 | A1* | 5/2008 | Kovacs | G07F 17/3211 463/16 |
| 2008/0155436 | A1 | 6/2008 | Hirano | |
| 2008/0167125 | A1* | 7/2008 | Dias Pires | G07F 17/32 463/31 |
| 2011/0018200 | A1 | 1/2011 | Facchini | |
| 2011/0304549 | A1 | 12/2011 | Suverien et al. | |
| 2013/0331173 | A1* | 12/2013 | Jaffe | G07F 17/3288 463/21 |

FOREIGN PATENT DOCUMENTS

| | | | |
|---|---|---|---|
| CA | 2325413 | A1 | 5/2001 |
| CA | 2325413 | C | 1/2012 |
| CN | 2596489 | Y | 12/2003 |
| CN | 100998466 | A | 7/2007 |
| EP | 0607823 | A1 | 7/1994 |
| EP | 0649672 | A2 | 4/1995 |
| EP | 0649672 | A3 | 3/1996 |
| EP | 0607823 | B1 | 9/1998 |
| EP | 0649672 | B1 | 5/1999 |
| GB | 2333631 | A | 7/1999 |
| JP | 9294868 | A | 11/1997 |
| JP | 10066749 | A | 3/1998 |
| JP | 11033221 | A | 2/1999 |
| JP | 2000005379 | A | 1/2000 |
| JP | 2000126371 | A | 5/2000 |
| JP | 2002000810 | A | 1/2002 |
| JP | 3283428 | B2 | 5/2002 |
| JP | 2003199956 | A | 7/2003 |
| JP | 2003220186 | A | 8/2003 |
| JP | 3856967 | B2 | 12/2006 |
| JP | 2008246261 | A | 10/2008 |
| JP | 4232220 | B2 | 3/2009 |
| JP | 2009095498 | A | 5/2009 |
| JP | 4853854 | B2 | 1/2012 |
| MD | MD205 | Y | 5/2010 |
| MD | MD205 | Z | 12/2010 |
| RU | 2113263 | C1 | 6/1998 |
| WO | 03049825 | A1 | 6/2003 |
| WO | 2006086026 | A2 | 8/2006 |
| WO | 2006086026 | A3 | 10/2007 |

* cited by examiner

METHOD OF GAMING, A GAME CONTROLLER AND A GAMING SYSTEM

RELATED APPLICATIONS

This application claims priority to Australia Provisional Patent Application No. 2013900729 having an International filing date of Mar. 4, 2013, which is incorporated herein by reference in its entirety.

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

Gaming machines are known which include an element of game play where a number of games are conducted at the same time.

While such gaming machines provide players with enjoyment, a need exists for alternative gaming systems in order to maintain or increase player enjoyment.

BRIEF SUMMARY OF THE INVENTION

In a first aspect, the invention provides a method of gaming in a gaming system, the method comprising:

determining, for each of a plurality of game instances corresponding to respective ones of a plurality of display areas on a display, a set of symbols for display at a plurality of display positions arranged in an array in the respective display area, wherein determining the set of symbols comprises selecting one or more of the symbols and wherein selecting one or more of the symbols can result in the selection of a replicating symbol;

upon a replicating symbol being selected at a display position of at least one game instance that satisfies one or more adjacency criteria with respect to a corresponding display position of another game instance, replicating the replicating symbol at the corresponding display position of the other game instance; and evaluating symbols, including the replicated replicating symbol, displayed at the display positions of the other game instance to determine whether to make an award.

In an embodiment, the evaluation of symbols, including the replicated replicating symbol, displayed at the display positions of the other game instance is performed in a current game round of the other game instance.

In an embodiment, the evaluation of symbols, including the replicated replicating symbol, displayed at the display positions of the other game instance is performed in at least one subsequent game round of the other game instance.

In an embodiment, the method comprises conducting a plurality of game rounds of the game instances, and wherein determining a set of symbols comprises making each replicating symbol that causes or results in a replication persist at the display position at which it is selected or to which it is replicated in any subsequent game round.

In an embodiment, selecting one or more symbols comprises selecting symbols for display at each display position not occupied by a replicating symbol persisting from a prior game round.

In an embodiment, the replicating symbol is a wild symbol that can substitute for all other symbols in the formation of a winning combination of symbols.

In an embodiment, the display areas are positioned relative to one another such that a subset of the display positions of each array are adjacent a corresponding subset of display positions of at least one other one of the arrays and display positions at corresponding subsets of the display positions satisfy an adjacency criterion.

In an embodiment, an adjacency criterion is that the corresponding display position does not already have a replicating symbol.

In an embodiment, the method comprises, upon the replicated replicating symbol being replicated at a corresponding display position that satisfies at least one adjacency criterion with respect to a further corresponding display position of a further game instance, replicating the replicating symbol at the further corresponding display position.

In an embodiment, there are four game instances corresponding to respective ones of four display areas arranged relative to one another such that each display area has a respective common edge with two of the other display areas.

In an embodiment, each column of each array corresponds to a respective reel of symbols from which symbols are selected.

In an embodiment, there are five reels for each game instance and three display positions for each reel.

In an embodiment, the method comprises conducting the plurality of game instances in response to a trigger condition being met in respect of a base game.

In a second aspect, the invention provides a game controller for a gaming system, the game controller arranged to:

determine, for each of a plurality of game instances corresponding to respective ones of a plurality of display areas on a display, a set of symbols for display at a plurality of display positions arranged in an array in the respective display area, wherein determining the set of symbols comprises selecting one or more of the symbols and wherein selecting one or more of the symbols can result in the selection of a replicating symbol;

upon a replicating symbol being selected at a display position of at least one game instance that satisfies one or more adjacency criteria with respect to a corresponding display position of another game instance, replicate the replicating symbol at the corresponding display position of the other game instance; and evaluate symbols, including the replicated replicating symbol, displayed at the display positions of the other game instance to determine whether to make an award.

In an embodiment, the evaluation of symbols, including the replicated replicating symbol, displayed at the display positions of the other game instance is performed in a current game round of the other game instance.

In an embodiment, the evaluation of symbols, including the replicated replicating symbol, displayed at the display positions of the other game instance is performed in at least one subsequent game round of the other game instance.

In an embodiment, the game controller is arranged to conduct a plurality of game rounds of the game instances, and wherein each replicating symbol that causes or results in a replication persists at the display position at which it is selected or to which it is replicated in any subsequent game round.

In an embodiment, selecting one or more symbols comprises selecting symbols for display at each display position not occupied by a replicating symbol persisting from a prior game round.

In an embodiment, the replicating symbol is a wild symbol that can substitute for all other symbols in the formation of a winning combination of symbols.

In an embodiment, the display areas are positioned relative to one another such that a subset of the display positions of each array are adjacent a corresponding subset of display positions of at least one other one of the arrays and display positions at corresponding subsets of the display positions satisfy an adjacency criterion.

In an embodiment, an adjacency criterion is that the corresponding display position does not already have a replicating symbol.

In an embodiment, the game controller is arranged to, upon the replicated replicating symbol being replicated at a corresponding display position that satisfies at least one adjacency criterion with respect to a further corresponding display position of a further game instance, replicates the replicating symbol at the further corresponding display position.

In an embodiment, there are four game instances corresponding to respective ones of four display areas arranged relative to one another such that each display area has a respective common edge with two of the other display areas.

In an embodiment, each column of each array corresponds to a respective reel of symbols from which symbols are selected.

In an embodiment, there are five reels for each game instance and three display positions for each reel.

In an embodiment, the game controller is arranged to conduct the plurality of game instances in response to a trigger condition being met in respect of a base game.

In a third aspect, the invention provides a gaming system comprising:

a display;

a symbol determiner for determining, for each of a plurality of game instances corresponding to respective ones of a plurality of display areas on a display, a set of symbols for display at a plurality of display positions arranged in an array in the respective display area, wherein determining the set of symbols comprises a symbol selector selecting one or more of the symbols and wherein selecting one or more of the symbols by the symbol selector can result in the selection of a replicating symbol;

a symbol replicator for, upon a replicating symbol being selected at a display position of at least one game instance that satisfies one or more adjacency criteria with respect to a corresponding display position of another game instance, replicating the replicating symbol at the corresponding display position of the other game instance; and a symbol evaluator for evaluating symbols, including the replicated replicating symbol, displayed at the display positions of the other game instance to determine whether to make an award.

In an embodiment, the evaluation of symbols, including the replicated replicating symbol, displayed at the display positions of the other game instance is performed by the symbol evaluator in a current game round of the other game instance.

In an embodiment, the evaluation of symbols, including the replicated replicating symbol, displayed at the display positions of the other game instance is performed by the symbol evaluator in at least one subsequent game round of the other game instance.

In an embodiment, the gaming system is arranged to conduct a plurality of game rounds of the game instances, and wherein the symbol determiner is arranged such that each replicating symbol that causes or results in a replication persists at the display position at which it is selected or to which it is replicated in any subsequent game round.

In an embodiment, the symbol selector selects symbols for display at each display position not occupied by a replicating symbol persisting from a prior game round.

In an embodiment, the replicating symbol is a wild symbol that can substitute for all other symbols in the formation of a winning combination of symbols.

In an embodiment, the display areas are positioned relative to one another such that a subset of the display positions of each array are adjacent a corresponding subset of display positions of at least one other one of the arrays and display positions at corresponding subsets of the display positions satisfy an adjacency criterion.

In an embodiment, an adjacency criterion is that the corresponding display position does not already have a replicating symbol.

In an embodiment, the symbol replicator is arranged to, upon the replicated replicating symbol being replicated at a corresponding display position that satisfies at least one adjacency criterion with respect to a further corresponding display position of a further game instance, replicate the replicating symbol at the further corresponding display position.

In an embodiment, there are four game instances corresponding to respective ones of four display areas arranged relative to one another such that each display area has a respective common edge with two of the other display areas.

In an embodiment, each column of each array corresponds to a respective reel of symbols from which symbols are selected.

In an embodiment, there are five reels for each game instance and three display positions for each reel.

In an embodiment, the gaming system is arranged to conduct the plurality of game instances in response to a trigger condition being met in respect of a base game.

In a fourth aspect, the invention provides a gaming system comprising:

means for determining, for each of a plurality of game instances corresponding to respective ones of a plurality of display areas on a display, a set of symbols for display at a plurality of display positions arranged in an array in the respective display area, wherein determining the set of symbols comprises selecting one or more of the symbols and wherein selecting one or more of the symbols can result in the selection of a replicating symbol;

means for, upon a replicating symbol being selected at a display position of at least one game instance that satisfies one or more adjacency criteria with respect to a corresponding display position of another game instance, replicating the replicating symbol at the corresponding display position of the other game instance; and means for evaluating symbols, including the replicated replicating symbol, displayed at the display positions of the other game instance to determine whether to make an award.

In a fifth aspect, the invention provides computer program code which when executed implements the above method.

In a sixth aspect, the invention provides a tangible computer readable medium comprising the above program code.

BRIEF DESCRIPTION OF SEVERAL VIEWS OF THE DRAWINGS

An exemplary embodiment of the invention will now be described with reference to the accompanying drawings in which.

DETAILED DESCRIPTION OF THE INVENTION

Figure 1:
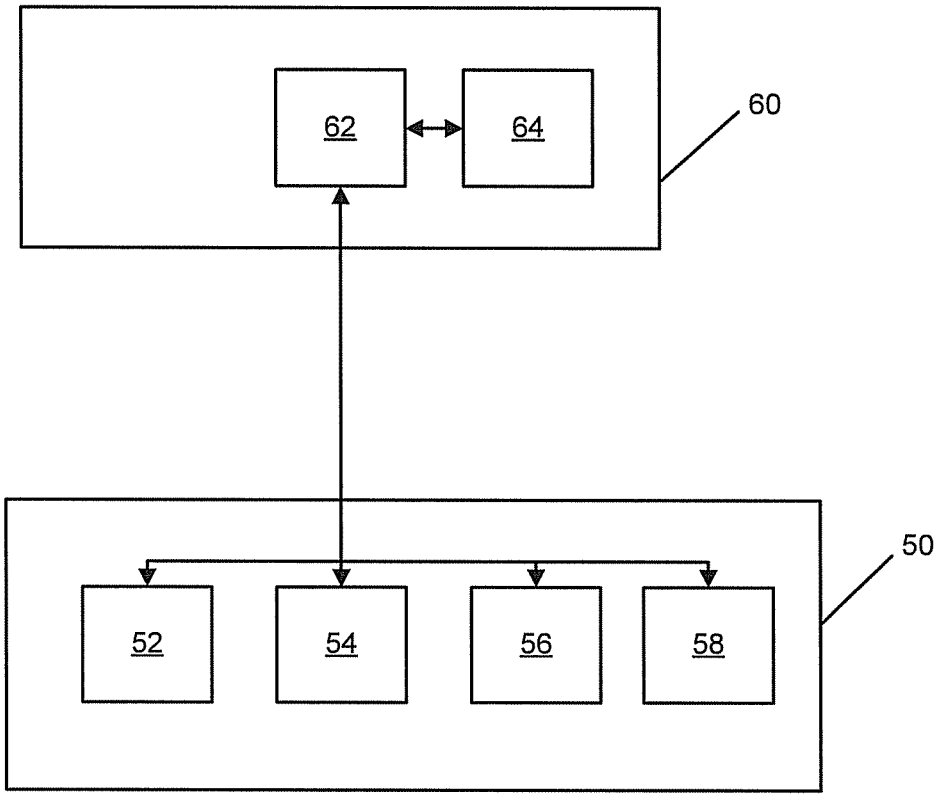
FIG. 1 is a block diagram of the core components of a gaming system.

Referring to the drawings, there is shown a gaming system having a game controller arranged to implement plural game instances in different display areas on one or more displays of the gaming system. The game instances each involve selecting symbols for display at an array of display positions. The selected symbols can include a replicating symbol. If the replicating symbol occurs at a display position of one of the display areas that satisfies one or more adjacency criteria with respect to a corresponding display position of another one of the display areas, the symbol is replicated at the corresponding display position. The replicated symbol then forms part of an award evaluation, in the current game round and/or in a subsequent game round.

General Construction of Gaming System

The gaming system can take a number of different forms. In a first form, a stand alone gaming machine is provided wherein all or most components required for implementing the game are present in a player operable gaming machine.

In a second form, a distributed architecture is provided wherein some of the components required for implementing the game are present in a player operable gaming machine and some of the components required for implementing the game are located remotely relative to the gaming machine. For example, a "thick client" architecture may be used wherein part of the game is executed on a player operable gaming machine and part of the game is executed remotely, such as by a gaming server; or a "thin client" architecture may be used wherein most of the game is executed remotely such as by a gaming server and a player operable gaming machine is used only to display audible and/or visible gaming information to the player and receive gaming inputs from the player.

However, it will be understood that other arrangements are envisaged. For example, an architecture may be provided wherein a gaming machine is networked to a gaming server and the respective functions of the gaming machine and the gaming server are selectively modifiable. For example, the gaming system may operate in stand alone gaming machine mode, "thick client" mode or "thin client" mode depending on the game being played, operating conditions, and so on. Other variations will be apparent to persons skilled in the art.

Irrespective of the form, the gaming system has several core components. At the broadest level, the core components are a player interface 50 and a game controller 60 as illustrated in FIG. 1. The player interface is arranged to enable manual interaction between a player and the gaming system and for this purpose includes the input/output components required for the player to enter instructions to play the game and observe the game outcomes.

Components of the player interface may vary from embodiment to embodiment but will typically include a credit mechanism 52 to enable a player to input credits and receive payouts, one or more displays 54, a game play mechanism 56 including one or more input devices that enable a player to input game play instructions (e.g. to place a wager), and one or more speakers 58.

The game controller 60 is in data communication with the player interface and typically includes a processor 62 that processes the game play instructions in accordance with game play rules and outputs game play outcomes to the display. Typically, the game play rules are stored as program code in a memory 64 but can also be hardwired. Herein the term "processor" is used to refer generically to any device that can process game play instructions in accordance with game play rules and may include: a microprocessor, microcontroller, programmable logic device or other computational device, a general purpose computer (e.g. a PC) or a server. That is a processor may be provided by any suitable logic circuitry for receiving inputs, processing them in accordance with instructions stored in memory and generating outputs (for example on the display). Such processors are sometimes also referred to as central processing units (CPUs). Most processors are general purpose units, however, it is also know to provide a specific purpose processor using an application specific integrated circuit (ASIC) or a field programmable gate array (FPGA).

Figure 2:
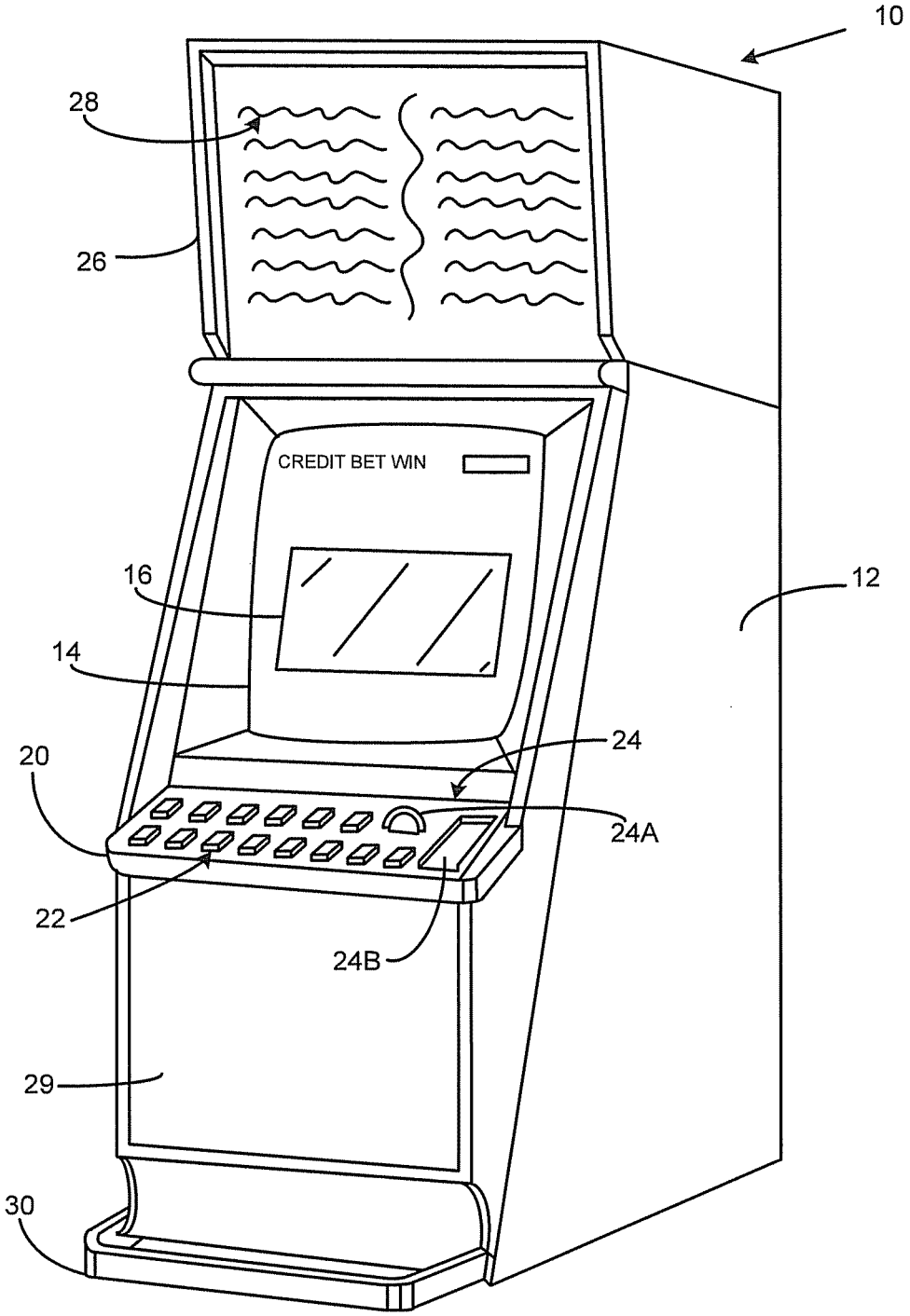
FIG. 2 is a perspective view of a stand alone gaming machine.

A gaming system in the form of a stand alone gaming machine 10 is illustrated in FIG. 2. The gaming machine 10 includes a console 12 having a display 14 on which are displayed representations of a game 16 that can be played by a player. A mid-trim 20 of the gaming machine 10 houses a bank of buttons 22 for enabling a player to interact with the gaming machine, in particular during game play. The mid-trim 20 also houses a credit input mechanism 24 which in this example includes a coin input chute 24A and a bill collector 24B. Other credit input mechanisms may also be employed, for example, a card reader for reading a smart card, debit card or credit card. Other gaming machines may configure for ticket in such that they have a ticket reader for reading tickets having a value and crediting the player based on the face value of the ticker. A player marketing module (not shown) having a reading device may also be provided for the purpose of reading a player tracking device, for example as part of a loyalty program. The player tracking device may be in the form of a card, flash drive or any other portable storage medium capable of being read by the reading device. In some embodiments, the player marketing module may provide an additional credit mechanism, either by transferring credits to the gaming machine from credits stored on the player tracking device or by transferring credits from a player account in data communication with the player marketing module.

A top box 26 may carry artwork 28, including for example pay tables and details of bonus awards and other information or images relating to the game. Further artwork and/or information may be provided on a front panel 29 of the console 12. A coin tray 30 is mounted beneath the front panel 29 for dispensing cash payouts from the gaming machine 10.

The display 14 shown in FIG. 2 is in the form of a video display unit, particularly a cathode ray tube screen device. Alternatively, the display 14 may be a liquid crystal display, plasma screen, any other suitable video display unit, or the visible portion of an electromechanical device. The top box 26 may also include a display, for example a video display unit, which may be of the same type as the display 14, or of a different type.

Figure 3:
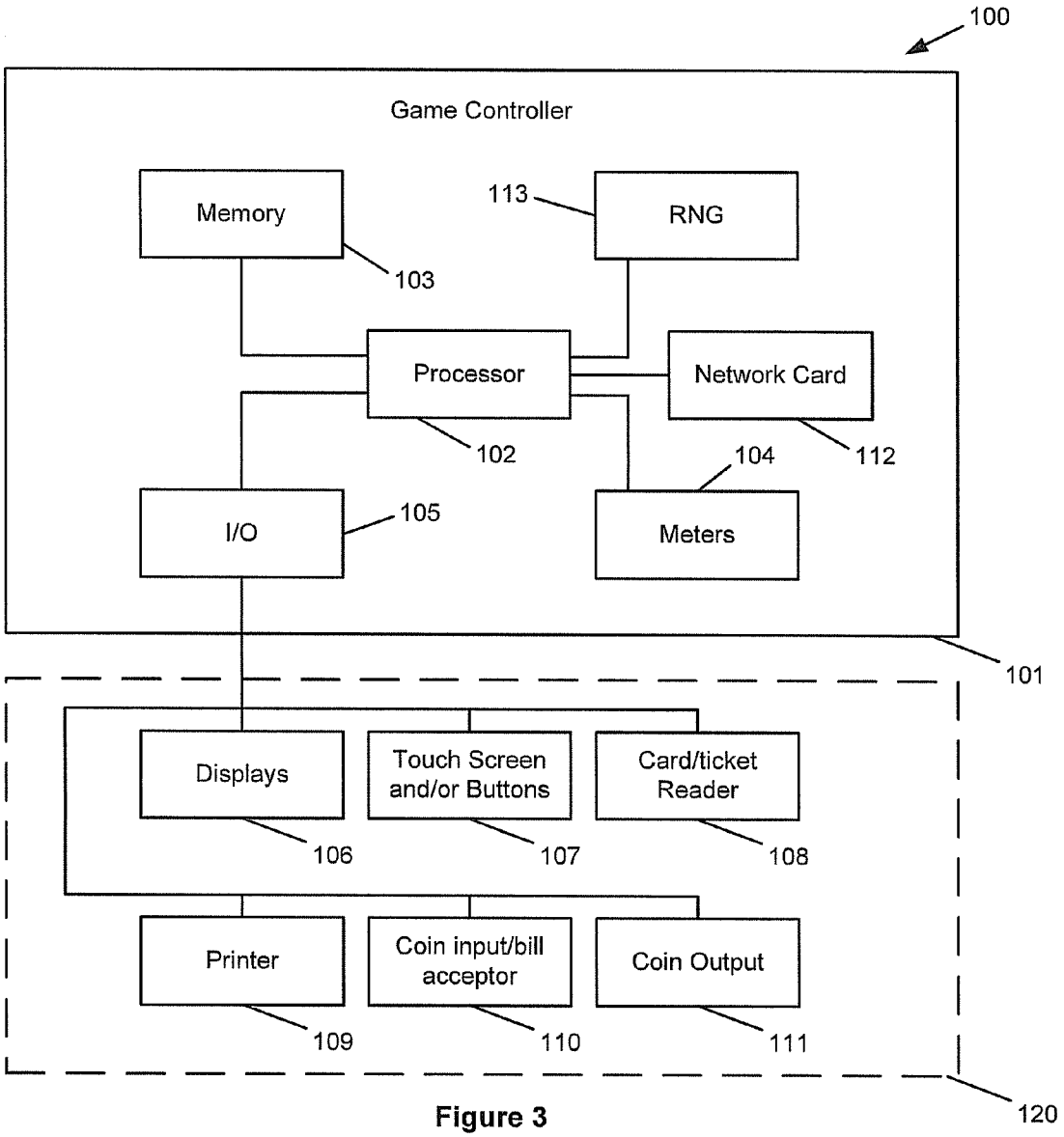
FIG. 3 is a block diagram of the functional components of a gaming machine.

FIG. 3 shows a block diagram of operative components of a typical gaming machine which may be the same as or different to the gaming machine of FIG. 2.

The gaming machine 100 includes a game controller 101 having a processor 102 mounted on a circuit board. Instructions and data to control operation of the processor 102 are stored in a memory 103, which is in data communication with the processor 102. Typically, the gaming machine 100 will include both volatile and non-volatile memory and more than one of each type of memory, with such memories being collectively represented by the memory 103.

The gaming machine has hardware meters 104 for purposes including ensuring regulatory compliance and monitoring player credit, an input/output (I/O) interface 105 for communicating with peripheral devices of the gaming machine 100. The input/output interface 105 and/or the peripheral devices may be intelligent devices with their own memory for storing associated instructions and data for use with the input/output interface or the peripheral devices. A random number generator module 113 generates random numbers for use by the processor 102. Persons skilled in the art will appreciate that the reference to random numbers includes pseudo-random numbers.

In the example shown in FIG. 3, a player interface 120 includes peripheral devices that communicate with the game controller 101 including one or more displays 106, a touch screen and/or buttons 107 (which provide a game play mechanism), a card and/or ticket reader 108, a printer 109, a bill acceptor and/or coin input mechanism 110 and a coin output mechanism 111. Additional hardware may be included as part of the gaming machine 100, or hardware may be omitted as required for the specific implementation. For example, while buttons or touch screens are typically used in gaming machines to allow a player to place a wager and initiate a play of a game any input device that enables the player to input game play instructions may be used. For example, in some gaming machines a mechanical handle is used to initiate a play of the game. Persons skilled in the art will also appreciate that a touch screen can be used to emulate other input devices, for example, a touch screen can display virtual buttons which a player can "press" by touching the screen where they are displayed.

In addition, the gaming machine 100 may include a communications interface, for example a network card 112. The network card may, for example, send status information, accounting information or other information to a bonus controller, central controller, server or database and receive data or commands from the bonus controller, central controller, server or database. In embodiments employing a player marketing module, communications over a network may be via player marketing module—i.e. the player marketing module may be in data communication with one or more of the above devices and communicate with it on behalf of the gaming machine.

Figure 4:
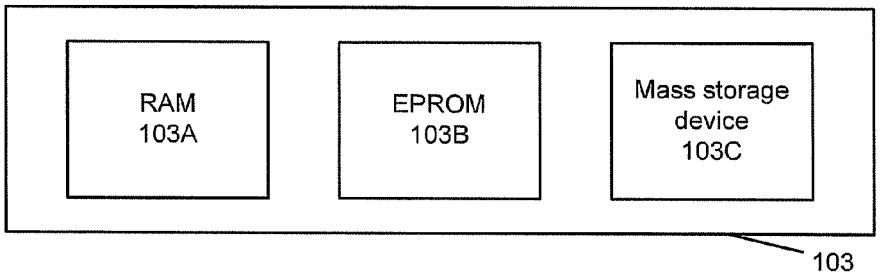
FIG. 4 is a schematic diagram of the functional components of a memory.

FIG. 4 shows a block diagram of the main components of an exemplary memory 103. The memory 103 includes RAM 103A, EPROM 103B and a mass storage device 103C. The RAM 103A typically temporarily holds program files for execution by the processor 102 and related data. The EPROM 103B may be a boot ROM device and/or may contain some system or game related code. The mass storage device 103C is typically used to store game programs, the integrity of which may be verified and/or authenticated by the processor 102 using protected code from the EPROM 103B or elsewhere.

It is also possible for the operative components of the gaming machine 100 to be distributed, for example input/output devices 106,107,108,109,110,111 to be provided remotely from the game controller 101.

Figure 5:
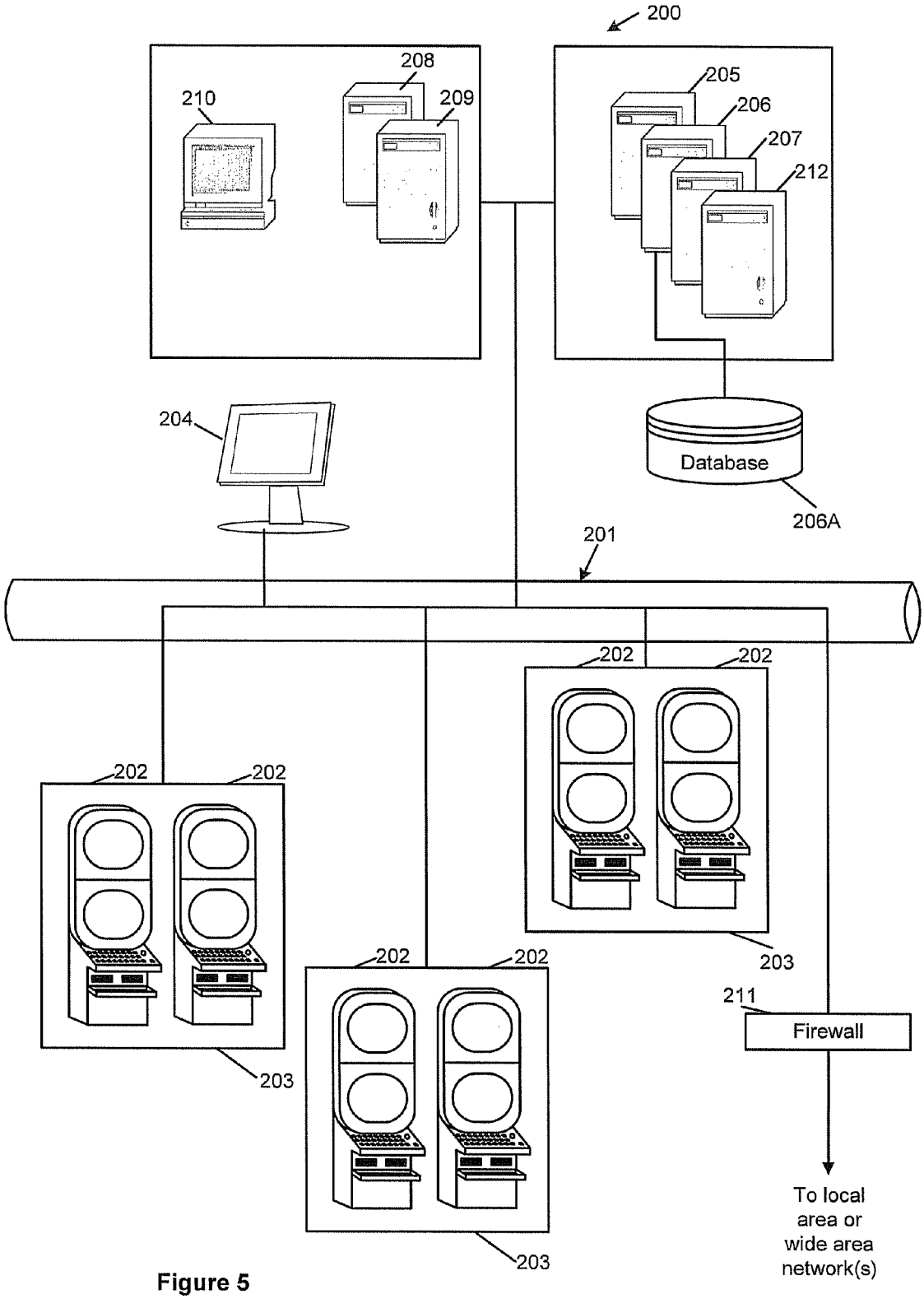
FIG. 5 is a schematic diagram of a network gaming system.

FIG. 5 shows a gaming system 200 in accordance with an alternative embodiment. The gaming system 200 includes a network 201, which for example may be an Ethernet network. Gaming machines 202, shown arranged in three banks 203 of two gaming machines 202 in FIG. 5, are connected to the network 201. The gaming machines 202 provide a player operable interface and may be the same as the gaming machines 10,100 shown in FIGS. 2 and 3, or may have simplified functionality depending on the requirements for implementing game play. While banks 203 of two gaming machines are illustrated in FIG. 5, banks of one, three or more gaming machines are also envisaged.

One or more displays 204 may also be connected to the network 201. For example, the displays 204 may be associated with one or more banks 203 of gaming machines. The displays 204 may be used to display representations associated with game play on the gaming machines 202, and/or used to display other representations, for example promotional or informational material.

In a thick client embodiment, game server 205 implements part of the game played by a player using a gaming machine 202 and the gaming machine 202 implements part of the game. With this embodiment, as both the game server and the gaming device implement part of the game, they collectively provide a game controller. A database management server 206 may manage storage of game programs and associated data for downloading or access by the gaming devices 202 in a database 206A. Typically, if the gaming system enables players to participate in a Jackpot game, a Jackpot server 207 will be provided to perform accounting functions for the Jackpot game. A loyalty program server 212 may also be provided.

In a thin client embodiment, game server 205 implements most or all of the game played by a player using a gaming machine 202 and the gaming machine 202 essentially provides only the player interface. With this embodiment, the game server 205 provides the game controller. The gaming machine will receive player instructions, pass these to the game server which will process them and return game play outcomes to the gaming machine for display. In a thin client embodiment, the gaming machines could be computer terminals, e.g. PCs running software that provides a player interface operable using standard computer input and output components. Other client/server configurations are possible, and further details of a client/server architecture can be found in WO 2006/052213 and PCT/SE2006/000559, the disclosures of which are incorporated herein by reference.

Servers are also typically provided to assist in the administration of the gaming network 200, including for example a gaming floor management server 208, and a licensing server 209 to monitor the use of licenses relating to particular games. An administrator terminal 210 is provided to allow an administrator to run the network 201 and the devices connected to the network.

The gaming system 200 may communicate with other gaming systems, other local networks, for example a corporate network, and/or a wide area network such as the Internet, for example through a firewall 211.

Persons skilled in the art will appreciate that in accordance with known techniques, functionality at the server side of the network may be distributed over a plurality of different computers. For example, elements may be run as a single "engine" on one server or a separate server may be provided. For example, the game server 205 could run a random generator engine. Alternatively, a separate random number generator server could be provided. Further, persons skilled in the art will appreciate that a plurality of game servers could be provided to run different games or a single game server may run a plurality of different games as required by the terminals.

Further Detail of Gaming System

The player operates the game play mechanism 56 to specify a wager and hence win entitlements which will be evaluated for this play of the game and initiates a play of the game. Persons skilled in the art will appreciate that a player's win entitlement will vary from game to game dependent on player selections. In most spinning reel games, it is typical for the player's entitlement to be affected by the amount they wager and selections they make (i.e. the nature of the wager). For example, a player's win entitlement may be based on how many lines they play in each game—e.g. a minimum of one line up to the maximum number of lines allowed by the game (noting that not all permutations of win lines may be available for selection) and how much they wager per line. Such win lines are typically formed by a combination of symbol display positions, one from each reel, the symbol display positions being located relative to one another such that they form a line.

In many games, the player's win entitlement is not strictly limited to the lines they have selected, for example, "scatter" pays are awarded independently of a players selection of pay lines and are an inherent part of the win entitlement.

Persons skilled in the art, will appreciate that in other embodiments, the player may obtain a win entitlement by selecting a number of reels to play and an amount to wager per reel. Such games are marketed under the trade name "Reel Power" by Aristocrat Leisure Industries Pty Ltd. The selection of the reel means that each displayed symbol of the reel can be substituted for a symbol at one or more designated display positions. In other words, all symbols displayed at symbol display positions corresponding to a selected reel can be used to form symbol combinations with symbols displayed at a designated, symbol display positions of the other reels. For example, if there are five reels and three symbol display positions for each reel such that the symbol display positions comprise three rows of five symbol display positions, the symbols displayed in the centre row are used for non-selected reels. The total number of ways to win is determined by multiplying the number of active display positions of each reels, the active display positions being all display positions of each selected reel and the designated display position of the non-selected reels. As a result for five reels and fifteen display positions there are 243 ways to win.

In other embodiments a player win entitlement may be affected by purchasing access to particular pay tables—e.g. a first bet amount entitles the player to wins including cherry symbols and a second amount entitles them to wins including plum symbols.

Figure 6:
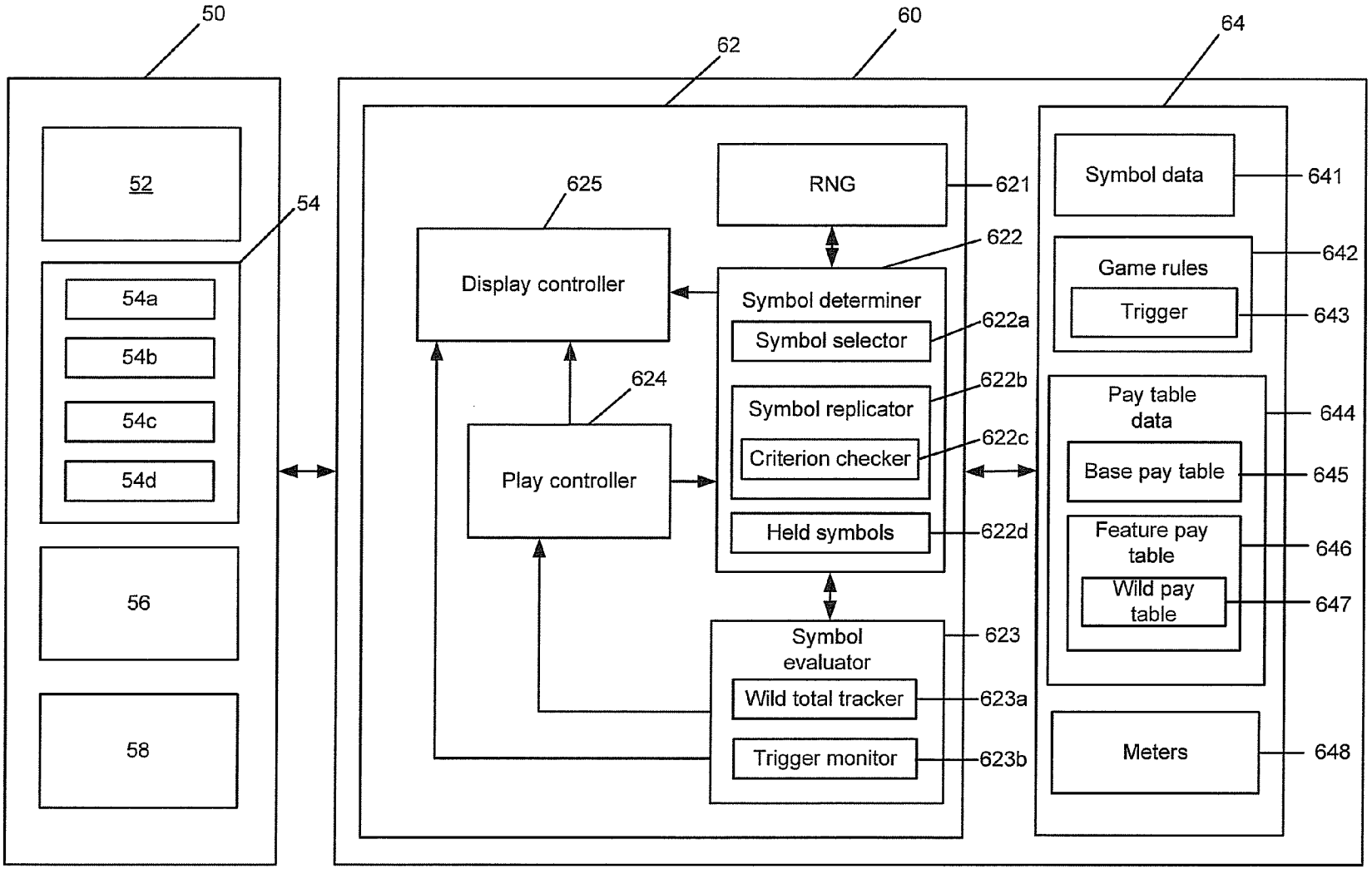
FIG. 6 is a further block diagram of a gaming system.

In FIG. 6, the processor 62 of game controller 60 is shown implementing a number of modules based on program code and data stored in memory 64. Persons skilled in the art will appreciate that various of the modules could be implemented in some other way, for example by a dedicated circuit.

In the embodiment, a play controller 624 operates in response to the player's operation of game play mechanism 56 to place a wager and initiate a play of the game to control play of the game based on game rules 642 in memory 64 until the play of the game is completed. In this embodiment, game play comprises a base game which is carried out each time the player makes a wager, typically irrespective of the wager, and a feature game that will only be carried out occasionally, in this if a trigger event occurs (or a trigger condition is met). The trigger event may be, a symbol combination in the game, occurrence of a specific symbol in the game, purchased, be caused by another connected system, be based on turnover, be based on a random evaluation, etc.

It will be appreciated that in some embodiments the plural display area feature game described below could be provided on its own without play of a base game. For example, the player may be able to play it in response to a specific wager being made.

To implement the base game, the play controller 624 controls the symbol determiner 622 to determine a set of symbols for display on display 54. In the base game, symbols are selected for each display position in an array of display positions. In the embodiment, the array has a number of rows and columns with the columns corresponding to spinning reels. Dimensions of the array may be, for example, five columns of three symbols each or three columns of threes symbols. The symbol selector 622A selects symbols from a set of symbols specified by symbol data 641 using random number generator 621. The selected symbols are advised to the display controller 624 which causes them to be displayed on display 54 at a set of display positions.

As indicated above, in the embodiment, the symbol selector 622A selects symbols for display from a plurality of symbol sets corresponding to respective ones of a plurality of spinning reels. The symbol sets 641 can specify a sequence of symbols for each reel such that the symbol selector 622A can select all of the symbols by selecting a stopping position in the sequence. In one example, three symbols of each of five reels may be displayed such that symbols are displayed at fifteen display positions on display 54. It is known to use a probability table stored in memory 64 to vary the odds of a particular stop position being selected. Other techniques can be used to control the odds of particular outcomes occurring to thereby control the return to player of the game.

After the symbols are selected, they are evaluated by the symbol evaluator 623 which compares the symbols at the positions against the set of winning outcomes defined in base pay table 645 of pay table data 644. The base pay table 645 defines various winning combinations of symbols such as three of a kind, four of a kind or five of a kind of a particular symbol. The symbol evaluator 623 also incorporates a trigger monitor 623*b* which monitors the selected symbols to determine whether a trigger condition 643 specified in game rules 642 is met. In one example, the trigger condition is the occurrence of three, four, or five scatter symbols in the selected symbols displayed on display 54. In one embodiment, the different numbers of scatter symbols correspond to different numbers of game rounds of a feature game that will be conducted as part of the play of a game. For example, 10, 15 and 20 five game rounds. Upon the trigger condition 643 occurring in any base game round, play controller 624 controls the game to carry out each of the game rounds awarded in accordance with game rules 642.

Initially, play controller 624 causes display controller 625 to modify the display 54 so that instead of a display of one set of reels there are four sets of reels (i.e. four separate game instances) displayed in respective ones of four display areas 54A to 54D. Play controller 624 then controls symbol determiner 622 to determine symbols for display at each of the display areas 54A to 54D. In the embodiment, each of the display areas 54A to 54D initially displays an array of display positions corresponding to what was displayed on the display when the trigger condition was met (i.e. the result of the base game). New symbols are then determined for each of the display positions based on the same symbol data, that is, the same reels, used in the base game. Persons skilled in the art will appreciate that in other embodiments, the reels may be modified for the feature game or different reels may be used in the feature game. Further, while at least the replicating symbol needs to be able to participate in winning outcomes in all games, the symbols of each game instance need not necessarily be the same. In this embodiment, the symbols of each of the four game instances are the same. The symbol determiner 622 is arranged such that in a first game round of the plurality of free game rounds conducted under control of the play controller 624, symbols are selected for display at each of the display positions of each of the display areas 54A to 54D.

Figure 8:
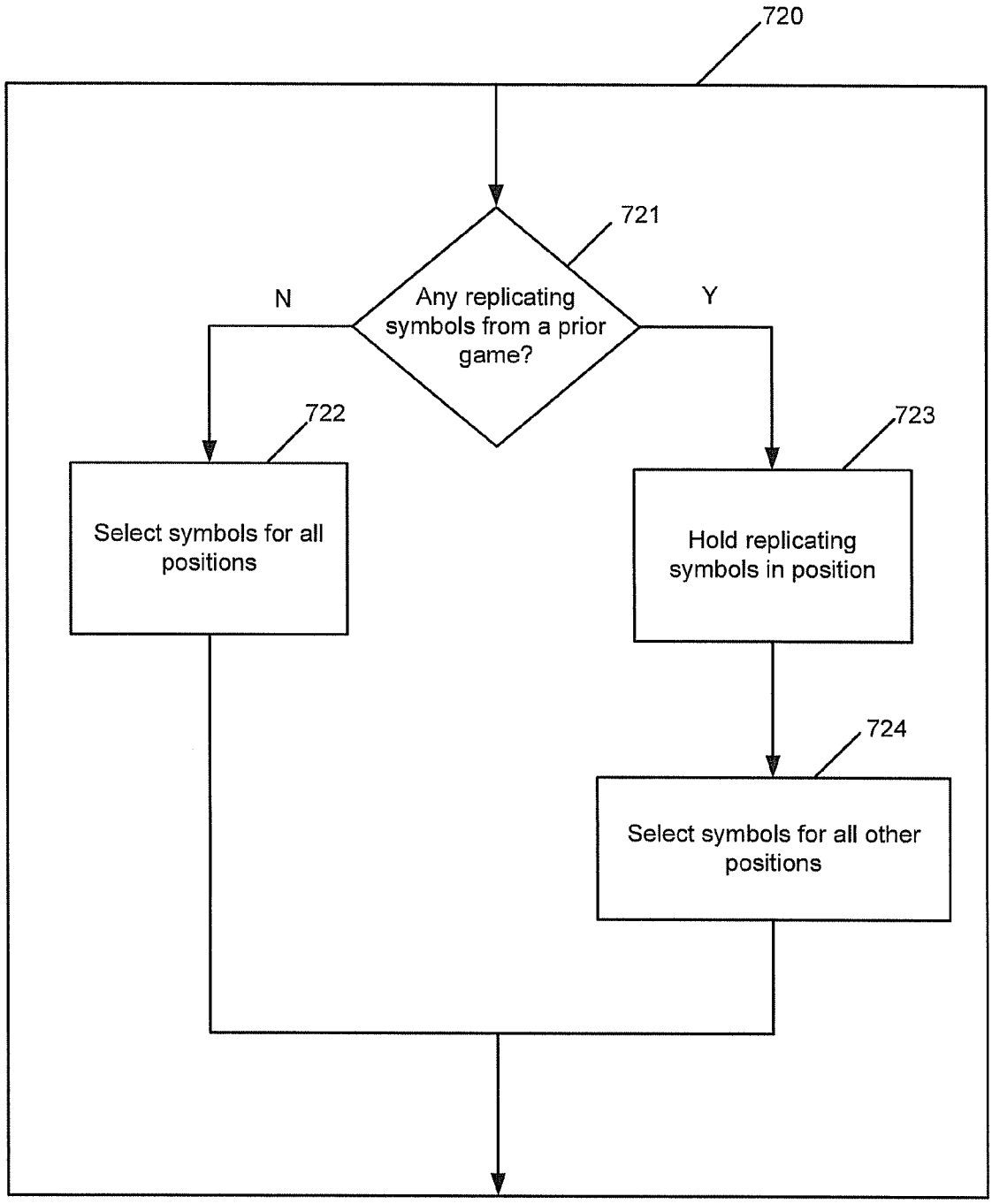
FIG. 8 is a flow chart of a process of determining symbols.
Figure 8A:
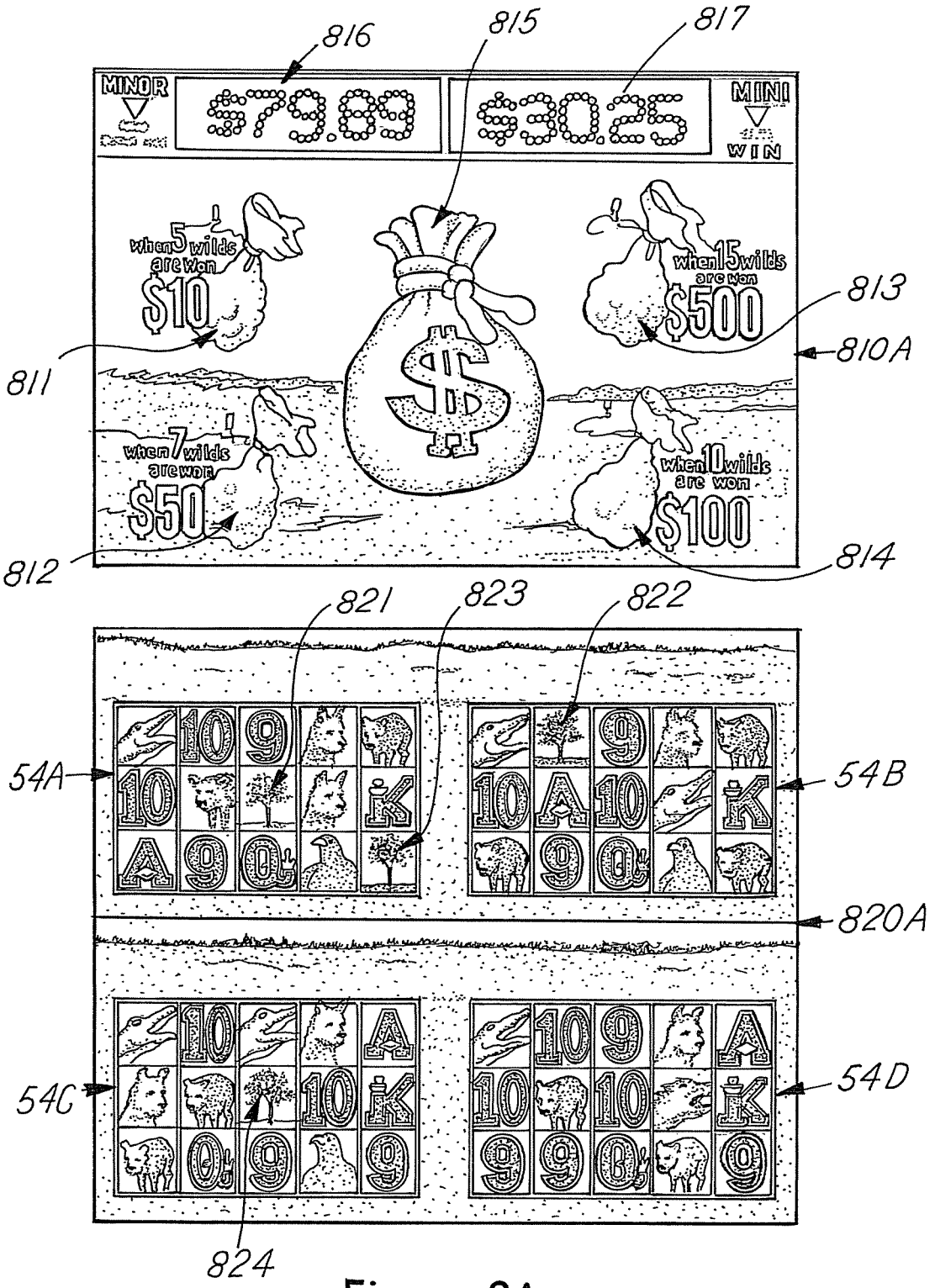
FIGS. 8A-8C show exemplary screen displays of an embodiment.

FIG. 8A, shows an example of such a display. From FIG. 8A it will be apparent that the player is displayed information about game play on two separate screens 810A and 820A which form part of the display 54. The top screen 810A displays the value of a minor jackpot 816 and the value of a mini jackpot 817. It also displays different award amounts which may be awarded in addition to awards for winning outcomes. In particular, it displays that a ten dollar prize is awarded when five WILD symbols are collected during the feature game, a fifty dollar prize is awarded when seven WILD symbols are collected 822, a five hundred dollar prize is awarded when fifteen WILD symbols are collected 813 and a one hundred dollar prize is awarded when ten WILD symbols are collected 814.

As indicated above, there are four sets of reels displayed in respective one of display areas 54A to 54D. Among the symbol selected in these display areas are four replicating symbols in the form of tree symbol 821, 823, 822 and 824. The tree symbol also acts as a WILD symbol in that is substitutes for all other symbols in winning combinations and will replicate between the display areas 54A to 54D upon one or more adjacency criteria being met.

In the embodiment, each replicating symbol which is either the basis for other symbols being replicated or results from a replication is held in place in future game rounds. In this respect, in this embodiment, the symbols are replicated before game outcomes are evaluated. For this purpose, the symbol determiner 622 includes a symbol replicator 622B that has a criterion checker 622C for determining whether the symbols satisfy an adjacency criterion.

In the embodiment, the adjacency criterion is that the replicating symbol is positioned at an edge of its own array of symbols that is also proximate an edge of an array of symbols in one or the other display areas. Accordingly, in the example shown in FIG. 8A, symbols 821 and 824 are arranged in the middle of the array and hence not along an edge that is proximate the edge of another array and accordingly, they will not be replicated as they fail to satisfy the adjacency criterion. Symbol 822 is position on an edge but this edge is not shared with any of the other arrays and hence it also doesn't satisfy the adjacency criterion. Symbol 823 which is in display area 54A is positioned where display area 54A (and hence the array of symbols) shares an edge with each of display area 54B and display area 54C and hence is replicated into each of these display areas by symbol replicator. As a consequence of the replication of tree symbol 823 into areas 54B and 54C, there is a further replication into area 54D as described in more detail below.

Once the symbol replication is complete, the displayed symbols are then evaluated by the symbol evaluator 623. The symbol evaluator evaluates them based on the feature game pay table 646 which may be the same of different to the base game pay table 644. For example, the feature game pay table may include an additional entry corresponding to what occurs when all WILD symbols are displayed along a single pay line. As part of the evaluation, the symbol evaluator 623 also includes a WILD total tracker 623*a* which updates the total of WILDs (i.e. tree symbols) that have occurred. In the embodiment, only WILD symbols that are held in future game rounds are added to the WILD total. In other embodiments all WILD symbols may be added to the total irrespective of whether they are held. In other embodiments all WILD symbols may be held, Referring to FIG. 8B, it can be seen that symbol 823 has been replicated based on the adjacency rules so as to result in display of symbols 825 and 826 (noting that the remainder of the reels have been re-spun in screen display 820B). As indicated above, a further tree symbol 827 results as a consequence of replicating symbols 826 and 825 being added to display positions that satisfies an adjacency criterion with respect to the position at which symbol at which symbol 827 is displayed. While this embodiment, advantageously shows the replicating symbol spreading, it will be appreciated that in other embodiments, an additional adjacency criterion could have been specified so that the symbol 823 directly caused the appearance of tree symbol 827 instead of via the indirect path described above.

Figure 8B:
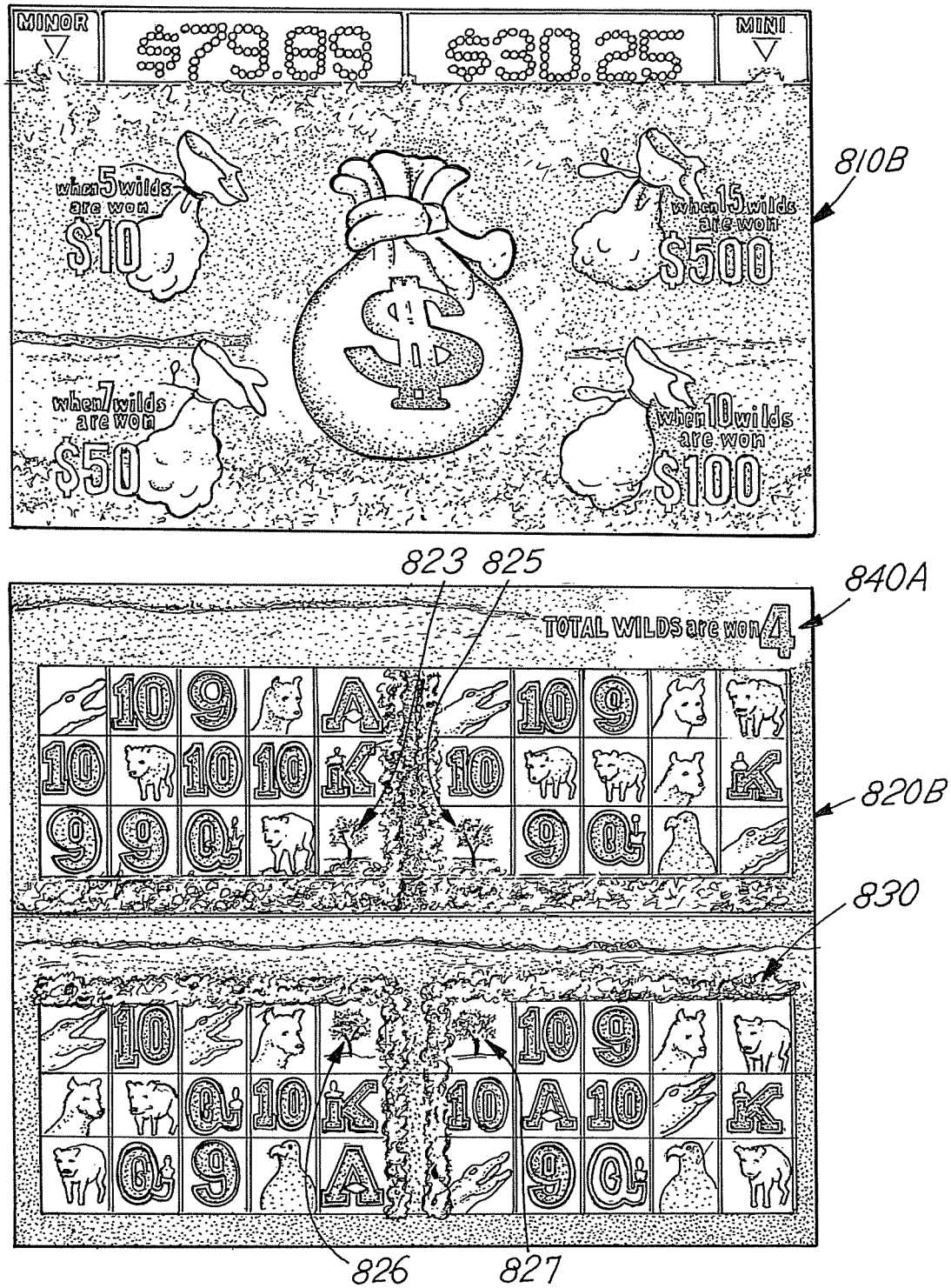

FIG. 8B shows a current total 840A of WILDs that have been collected that will be held in further game rounds and that the current total is four.

It will also be appreciated that a graphic of fire 830 is added to the edge to graphically indicate adjacency criterion, i.e. the display positions at which replication of symbols may occur.

Figure 8C:
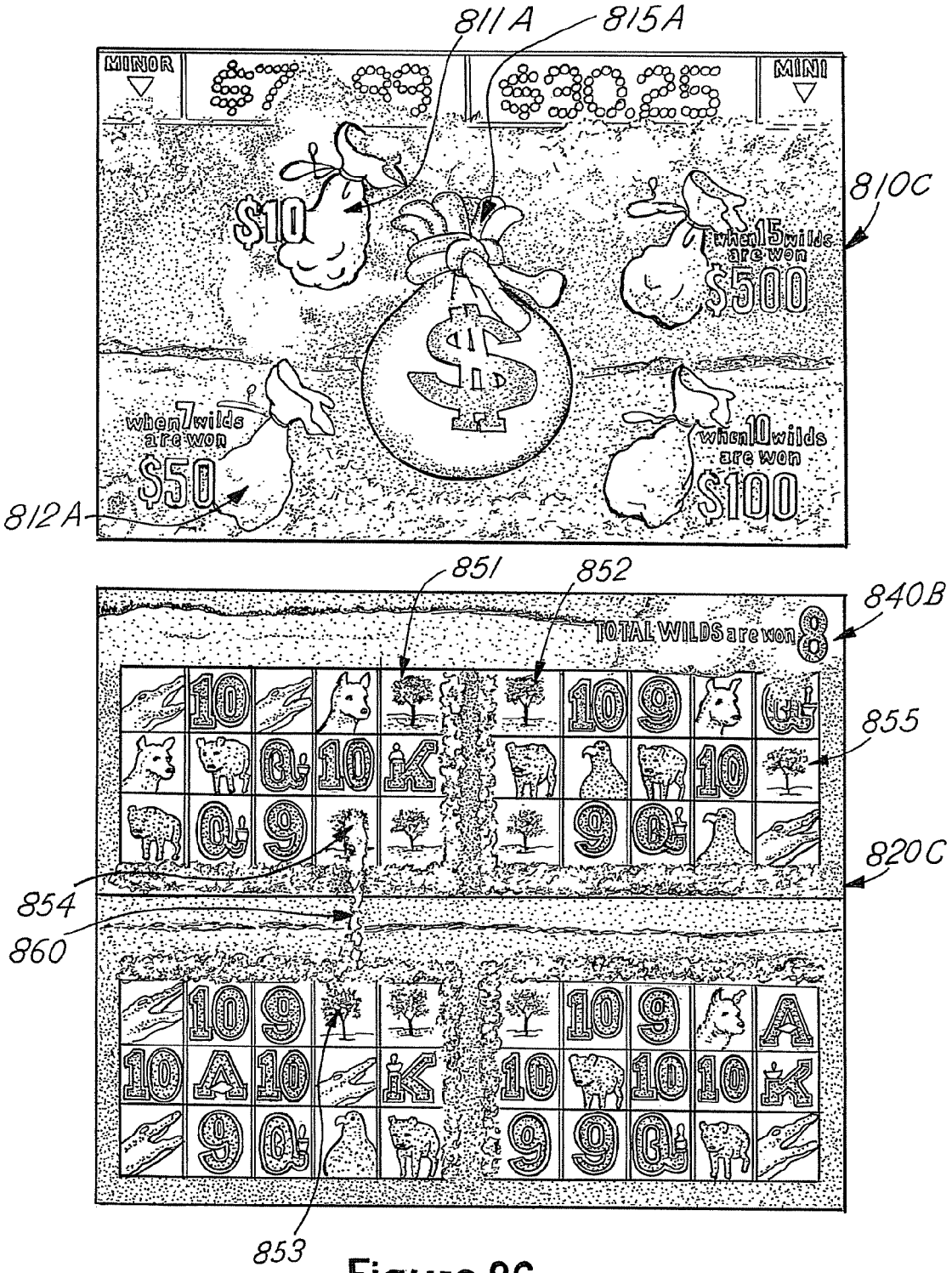

FIG. 8C shows updated screen displays 810C and 820C after a further subsequent game round. In this respect, it will be appreciated that the symbol determiner 622 does not select symbols for all display positions once certain symbols are held in place. In this respect, the symbol determiner 622 includes held symbols 622D that indicates which symbol positions are already occupied by a WILD symbol and the symbol selector 622A is controlled to operate in subsequent game rounds to only select symbols at those display positions that are not occupied by a held WILD symbol. To achieve this, the symbol selector 622A selects symbols randomly from the reels in the same manner described above but does not display the symbol that would have been displayed at the position occupied by the replicating symbol. In screen display 820C, it will be apparent that additional tree symbols have occurred at display positions 851 and 852. Screen display 820C also shows an animation of fire spreading from symbol 853 to symbol 854 as indicated by fire trail 860. Further, it will be seen that the total 840B of WILDs has been increased to eight as a result of this play. In this respect, it will be appreciated that in this embodiment, WILD symbol 855 does not participate in the total number of WILDs because it has not taken part in a replication.

As a result of the wild total reaching 8, two prizes are awarded for the collection of WILDs. FIG. 8C shows the prizes for collecting five WILDs is graphically being made by the sack of coins 811A being poured into moneybag 815A. Subsequent to this animation completing, sack of coins 812A will be shown as being poured into money sack 815A.

Persons skilled in the art will appreciate that game play continues until the game play controller determines that the set of game rounds of the feature game has finished. All wins are accumulated in win meter which forms part of meters 648 and are transferred to the credit meter when the player decides to initiate another play of the game or cashes out.

Persons skilled in the art will appreciate that there may be a number of variations on the above embodiment. For example, rather than two jackpots, three or four jackpot bonuses may be displayed. These jackpot prizes may be awarded dependent on the number of WILDs collected in the game. That is, the jackpot awards 816 and 817 shown in FIGS. 8A to 8C could be awarded for different number of WILDs collected such as 20 and 25 WILDs respectively. These jackpot awards can also be shown as being awarded by an animation of coins being poured into the money bag 815A.

Persons skilled in the art will appreciate that while in the above embodiment, the WILD symbols stay in play all the time provided they have participated in a replication event, in other embodiment, WILD symbols could only participate in a current game. In another variation, all WILD symbols can be held in position irrespective of whether they are involved in a replication or not.

Further, in the above embodiment, the symbol evaluation is performed after the WILD symbols have been replicated. In other embodiments, the symbol evaluation could be performed before the symbols are replicated such that they participate in a symbol evaluation only in a subsequent game round after fresh symbols have been selected at all of the other symbol positions.

Persons skilled in the art will appreciate that there can be other variations to the prize awarding. For example, in other embodiments, a single prize may be awarded to the player that depends on the number of WILD symbols they have collected at the end of the feature game.

Persons skilled in the art will appreciate that in other embodiments, not all of the display areas 54A-D may be active to begin with. For example, initially only one area might be active and then subsequently other areas may be activated upon a condition being met. In one example, they may be activated only when a replicating symbol is replicated into the display area.

Figure 9:
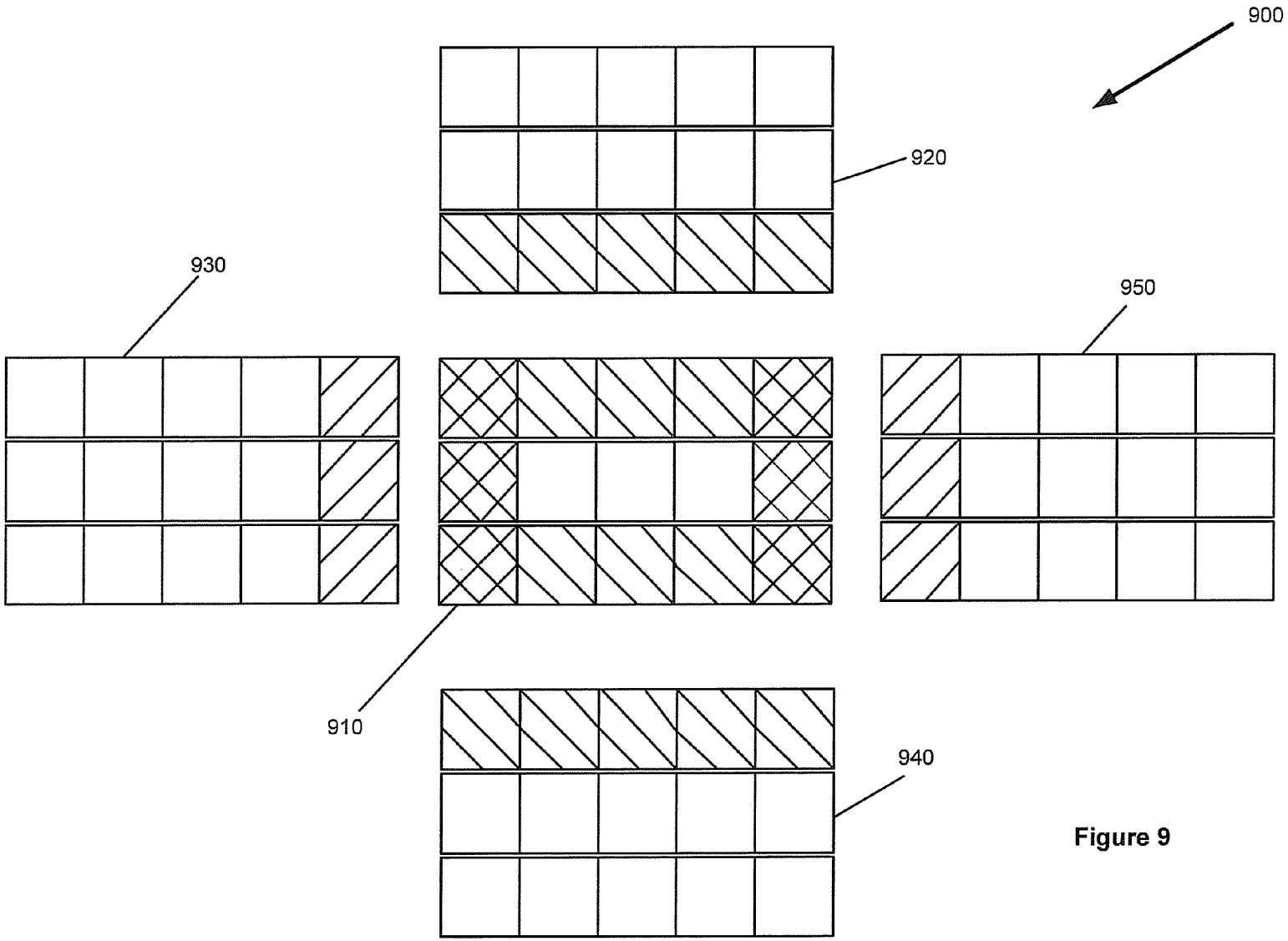
FIG. 9 illustrates an alternative arrangement of display areas.

Persons skilled in the art will appreciate that other embodiments are feasible. FIG. 9 shows one such example where there are five arrays with four satellite arrays 920, 930, 940 and 950 arranged around a central array 910 on a display 900.

In this embodiment, it will be appreciated that the central array 910 has a greater capacity to be involved in the replication of WILD symbols. In one example, the central display area operates in the same manner as described in relation to FIG. 8 but has a greater capacity to generate winning outcomes because of its ability to receive more replicating WILD symbols then the other display areas. This is shown by the shading of the display positions of the embodiment of FIG. 9 that satisfy the adjacency criterion.

In another embodiment, the symbols displayed in central display area 910 may be different to those in satellite areas 920, 930, 940 and 950. In one example, each of the satellite areas is arranged to display a set of reels whose spinning can result in winning outcome whereas the central area 910 display as alternative set of reels designed only to donate replicating WILD symbols to the other display area. In one such embodiment the central area 910 has a set of reels having a mixture of blank symbols and WILD symbols such that it is not involved in the generation of winning outcomes but can contribute to winning outcomes when replicating symbols are spun up and are replicated to the other display areas. In one example of such an embodiment, satellite areas 920, 930, 940 and 950 do not themselves generate symbols that result in replication of symbols such that there is a one way flow of replicating symbols between display areas 910 and display areas 920, 930, 940 and 950.

The embodiment of FIG. 9 can also involve the activation of the satellite areas in response to a WILD symbol spreading to the areas as described above.

In some embodiments, an eligibility criterion may be applied in order for the player to obtain either the replicating wild feature game itself or to activate replication of the wild symbols. For example that the player has made a certain sized wager, made an ante bet, selected all win lines, played sufficient games, or the player is a member of a loyalty program.

Persons skilled in the art will appreciate that the outcome of a game round of the feature game may be no win, a win (for example from a winning combination of symbols), a contribution towards a win accrued over a plurality of game rounds (such as the collection of wild symbols described above), further game play etc. Typically, a win will result in some form of award being made such as an award of credits. Such an award may never actually be physically received by a player. For example, many gaming systems provide a player with a double or nothing gamble feature, where the player can double or forfeit their credits before commencing another play of the game or cashing out. Further, as credits are fungible, once credits have been added to the credit meter it is not possible to distinguish between credits which exist because the player has input cash or the like and credits resulting from an award.

Figure 7:
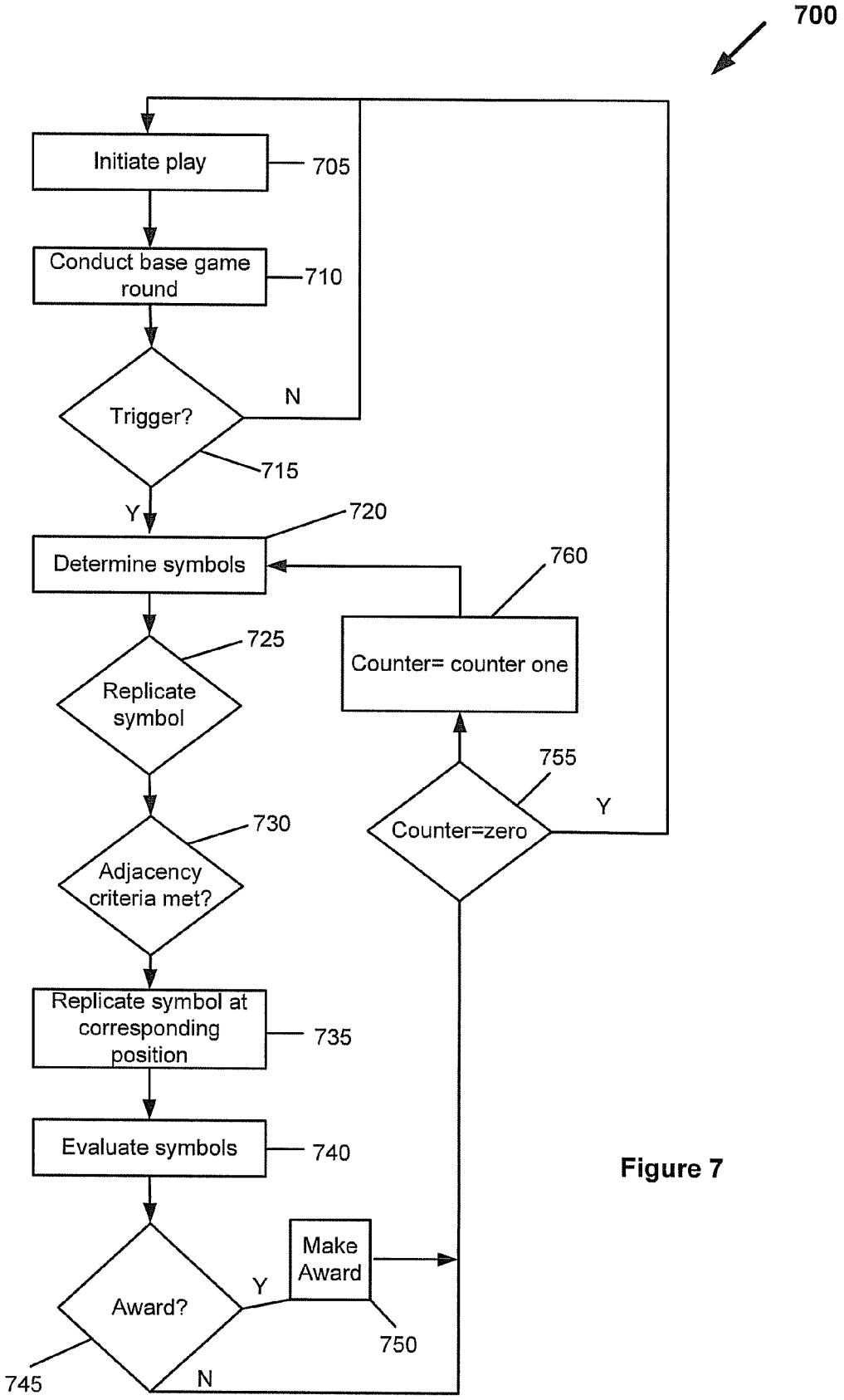
FIG. 7 is a flow chart of an embodiment.

A flowchart of the method 700 of the embodiment is shown in FIG. 7. Game play begins when a game player initiates play 705. A base game round is conducted 710 and it is determined whether a trigger event has occurred 715. If no trigger occurs, a further play needs to be initiated. If a trigger occurs, the display is changed to show the plurality of display areas and symbols are determined 720 for each of the sub areas. The process of determining symbols 720 is shown in FIG. 8. FIG. 8 shows that at the first sub step it is determined whether there are any replicating symbols from a prior game round 721. If there are no replicating symbols from a prior game round as will be the case when symbols are first selected, symbols are selected from all positions 722 if instead there are replicating symbols from a prior game round, these are held in position 723 and symbols are selected for all other positions 724.

Returning to FIG. 7, the method then involves determining whether the selected symbols 725 include a replicating symbol. It is then determined whether the adjacency criteria are met 730. In one example, the embodiment, the adjacency criteria are that the display positions neighbour those of the corresponding other one of the display areas and also that there is not already a replicating symbol at that position. If the adjacency criterion is met, a replicating symbol is replicated 735 at the corresponding display position in the array in the other display area.

The symbols are then evaluated 740 by symbol evaluator and it is determined 745 whether there is an award to make 750. The method continues by determining whether each of the game rounds of the feature game has been completed. In this example, by determining whether a counter has reached zero 755. If the counter has not reached zero, the counter is adjusted 760 the method proceeds by determining symbols to be displayed in the next game round 720. Once the counter reaches zero 755, the feature game ends and assuming the player does not activate a game or feature, all credits are transferred from the win meter to the credit meter.

Further aspects of the method will be apparent from the above description of the system. It will be appreciated that at least part of the method will be implemented electronically, for example, digitally by a processor executing program code such as in the above description of a game controller. In this respect, in the above description certain steps are described as being carried out by a processor of a gaming system, it will be appreciated that such steps will often require a number of sub-steps to be carried out for the steps to be implemented electronically, for example due to hardware or programming limitations. For example, to carry out a step such as evaluating, determining or selecting, a processor may need to compute several values and compare those values.

As indicated above, the method may be embodied in program code. The program code could be supplied in a number of ways, for example on a tangible computer readable storage medium, such as a disc or a memory device, e.g. an EEPROM, (for example, that could replace part of memory 103) or as a data signal (for example, by transmitting it from a server). Further different parts of the program code can be executed by different devices, for example in a client server relationship. Persons skilled in the art, will appreciate that program code provides a series of instructions executable by the processor.

It will be understood to persons skilled in the art of the invention that many modifications may be made without departing from the spirit and scope of the invention, in particular it will be apparent that certain features of embodiments of the invention can be employed to form further embodiments.

It is to be understood that, if any prior art is referred to herein, such reference does not constitute an admission that the prior art forms a part of the common general knowledge in the art in any country.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

The invention claimed is:

1. A gaming machine comprising:

a credit input mechanism configured to receive a physical item representing a monetary value for establishing a credit balance, the credit balance being increasable and decreasable based at least on wagering activity, a display configured to display concurrently a plurality of game instances, said display having a plurality of display areas, each display area configured to display one of the plurality of game instances, each display area having a plurality of display positions arranged in a rectangular matrix array having an outer edge;

a first plurality of sets of symbols, at least one of said sets of symbols having a second plurality of replicating symbols;

a memory storing data indicative of adjacency criteria, including an adjacency criterion defining a requirement of symbol adjacency for replicating a replicating symbol at a corresponding display position of another game instance, said requirement requiring both said corresponding display position and the display position of said replicating symbol to be displayed at the outer edge of its respective matrix array and to be laterally disposed to cause said replication;

a game controller configured to:

determine, in accord with the established credit balance, for each of the plurality of game instances, a set of symbols for display at respective ones of the display area areas;

select from each of the first plurality of sets of symbols a symbol for each display position of each matrix array;

replicate said replicating symbol being selected for display at a display position of at least one game instance that satisfies said adjacency criterion to a corresponding display position along the outer edge of another game instance; and display the determined symbols concurrently at the plurality of display positions;

evaluate the determined symbols, including each of said replicated replicating symbol, to determine whether to make an award; and a payout mechanism configured to provide the award.

2. A gaming machine as claimed in claim 1, wherein said game controller is configured to evaluate the determined symbols in a current game round.

3. A gaming machine as claimed in claim 1, and configured to conduct a plurality of game rounds, and wherein the evaluation of symbols, including each of the replicated replicating symbol, displayed at the display positions of the other game instance is performed in at least one subsequent game round of the other game instance.

4. A gaming machine a claimed in claim 1, configured to conduct a plurality of game rounds, each game round having a plurality of the game instances, and wherein said game controller is configured to cause each of the replicating symbol to persist at the display position at which it is selected or to which it is replicated in any subsequent game round.

5. A gaming machine as claimed in claim 4, wherein said game controller is configured to select symbols for display at each display position not occupied by each of the replicating symbol persisting from a prior game round.

6. A gaming machine as claimed in claim 1, wherein the replicating symbols are a wild symbol that can substitute for all other symbols in the formation of a winning combination of symbols.

7. A gaming machine as claimed in claim 1, wherein the display areas are positioned relative to one another such that a subset of the display positions of each matrix array are adjacent a corresponding subset of display positions of at least one other matrix array.

8. A gaming machine as claimed in claim 1, wherein the adjacency criterion requires that the corresponding display position does not already have the replicating symbol.

9. A gaming machine as claimed in claim 1, wherein said game controller is configured to, upon the replicating symbol being replicated at a corresponding display position and the adjacency criterion is satisfied with respect to a further corresponding display position, to further replicate the replicating symbol at the further corresponding display position.

10. A gaming machine as claimed in claim 1, wherein said plurality of game instances are four game instances corresponding to respective ones of four display areas arranged relative to one another such that each display area has a respective common edge with two of the other display areas.

11. A gaming machine as claimed in claim 1, wherein each column of each matrix array corresponds to a respective reel of symbols of one of said sets of symbols.

12. A gaming machine as claimed in claim 11, wherein there are five reels for each game instance and three display positions for each reel.

13. A gaming machine as claimed in claim 1, is configured to conduct the plurality of game instances in response to a trigger condition being met in respect of a base game.

14. A gaming machine comprising:

a credit input mechanism configured to receive a physical item representing a monetary value for establishing a credit balance, the credit balance being increasable and decreasable based at least on wagering activity, a display configured to display concurrently a plurality of game instances, said display having a plurality of display areas, each display area configured to display one of the plurality of game instances, each display area having a plurality of display positions arranged in a rectangular matrix array having an outer edge;

a first plurality of sets of symbols, each of said sets of symbols having a second plurality of replicating symbols;

a memory storing data indicative of adjacency criteria, said adjacency criteria defining a requirement of symbol adjacency for replicating a replicating symbol at a corresponding display position of another game instance, said requirement requiring both said corresponding display position and the display position of said replicating symbol to be displayed at the outer edge of its respective said matrix array and to be laterally disposed to cause said replication;

a symbol determiner configured to determine, in accord with the established credit balance, for each of the plurality of game, a set of symbols for display at a respective one of the display areas, said symbol determiner including a symbol selector configured to select from each of the first plurality of sets of symbols a symbol for each display position of each matrix array;

a symbol replicator configured to replicate said replicating symbol selected for display at a display position of at least one game instance that satisfies said adjacency criteria to a corresponding display position along the outer edge of another game instance;

a display controller configured to display the determined symbols concurrently at the plurality of display positions;

a symbol evaluator configured to evaluate the determined symbols, including the each said replicated replicating symbol to determine whether to make an award; and a payout mechanism configured to provide the award.

15. A gaming machine as claimed in claim 14, and having a current game round, and wherein said symbol evaluator is configured to evaluate the determined symbols, including each of said replicating symbol, displayed at the display positions of the other game instance in the current game round.

16. A gaming machine as claimed in claim 14, and having a subsequent game round, and wherein the symbol evaluator is configured to evaluate the determined symbols in at least one subsequent game round.

17. A gaming machine as claimed in claim 14, and having a plurality of game rounds of the game instances, and wherein the symbol determiner is configured to cause a replication to persist at the display position at which it is selected and at the display position at which it is replicated in a subsequent game round.

18. A gaming machine as claimed in claim 17, and having a plurality of game rounds, and wherein the symbol selector is configured to select symbols for display at each display position not occupied by the replicating symbol persisting from a prior game round.

19. A gaming machine as claimed in claim 14, wherein the replicating symbol is a wild symbol that can substitute for all other symbols in the formation of a winning combination of symbols.

20. A gaming machine as claimed in claim 14, wherein the display areas are positioned relative to one another such that a subset of the display positions of each array are adjacent a corresponding subset of display positions of at least one other one of the arrays.

21. A gaming machine as claimed in claim 14, wherein an adjacency criterion of the adjacency criterion is that the corresponding display position does not already have a replicating symbol.

22. A gaming machine as claimed in claim 14, wherein the symbol replicator is configured to, upon the replicated replicating symbol being replicated at a corresponding display position that satisfies at least one adjacency criterion with respect to a further corresponding display position of a further game instance, replicate the replicating symbol at the further corresponding display position.

23. A gaming machine as claimed in claim 14, wherein the plurality of game instances are four game instances, each corresponding to respective ones of four display areas, said four display areas being arranged relative to one another such that each display area has a respective common edge with two of the other display areas.

24. A gaming machine as claimed in claim 14, wherein each matrix column of each array corresponds to a respective reel of symbols from which symbols are selected.

25. A gaming machine as claimed in claim 24, wherein there are five reels for each game instance and three display positions for each reel.

26. A gaming machine as claimed in claim 14, arranged to conduct the plurality of game instances in response to a trigger condition being met in respect of a base game.

* * * * *